US005532117A

United States Patent [19]

Merkel et al.

[11] Patent Number: 5,532,117

[45] Date of Patent: Jul. 2, 1996

[54] PHOTOGRAPHIC ELEMENT CONTAINING CERTAIN AZOANILINE DYES

[75] Inventors: Paul B. Merkel; James P. Merrill; Jeffrey W. Schmoeger; Jared B. Mooberry, all of Rochester, N.Y.

[73] Assignee: Eastman Kodak Company, Rochester, N.Y.

[21] Appl. No.: 431,234

[22] Filed: Apr. 28, 1995

[51] Int. Cl.[6] ..... G03C 1/46

[52] U.S. Cl. ..... 430/504; 430/510; 430/511; 430/517; 430/519

[58] Field of Search ..... 430/517, 519, 430/510, 511, 503, 551, 504, 607, 546

[56] References Cited

U.S. PATENT DOCUMENTS 4,619,893 10/1986 Takagi et al. ..... 430/519

*Primary Examiner*—Janet C. Baxter
*Assistant Examiner*—Geraldine Letscher
*Attorney, Agent, or Firm*—Arthur E. Kluegel

[57] ABSTRACT

The invention provides a multicolor negative photographic element which contains a layer containing a yellow or orange-yellow azoaniline dye of structure I wherein:

$R_1$ is an alkyl group or a phenyl group;

$R_2$ is hydrogen or an alkyl group;

$R_3$ is an alkoxy, aryloxy or alkyl group when $R_2$ is hydrogen, or is hydrogen when $R_2$ is an alkyl group;

$R_1$ and $R_2$ or $R_1$ and $R_3$ may join to form a ring;

$R_4$, which may be in the para or meta position relative to the azo group, is an electron-withdrawing group selected from the group consisting of trifluoromethyl, cyano, halogen, and from alkoxycarbonyl, aryloxycarbonyl, acyloxy, carbonamido, sulfonamido, carbamoyl, sulfamoyl, alkylsulfonyl, arylsulfonyl, sulfonyloxy (—$OSO_3R$), alkoxysulfonyl, aryloxysulfonyl, and sulfoxide groups;

$R_5$ is hydrogen or, can be a chlorine in the meta position when $R_4$ is a chlorine in the para position; and the total number of carbon atoms in $R_1$, $R_2$, $R_3$, and $R_4$ taken together is at least 9;

wherein neither a layer sensitive to blue light nor a layer sensitive to green light is located between the support and the layer in which the azoaniline dye is located. The invention also provides a method of forming an image in an element of the invention.

15 Claims, No Drawings

PHOTOGRAPHIC ELEMENT CONTAINING CERTAIN AZOANILINE DYES

FIELD OF THE INVENTION

This invention relates to photographic elements comprising certain yellow or orange-yellow azoaniline dyes as antihalation dyes or dummy dyes and to a method of forming an image in such an element.

absorption at 480 nm to render the two negative films more printer compatible. The orange dye C3 has been used for this purpose. However, this dye does not have good stability, and when negatives containing it are printed following long-term storage color imbalances may be observed.

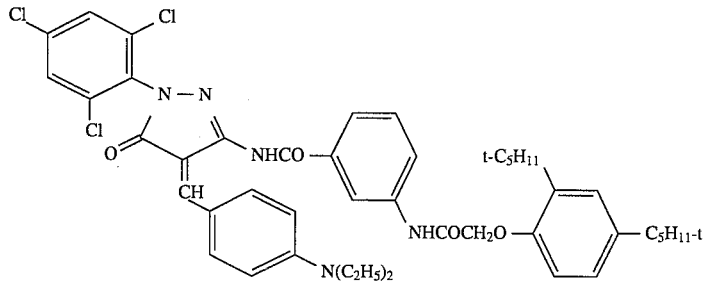

BACKGROUND OF THE INVENTION

Modern color negative films usually contain dyes coated in one or more layers for a variety of purposes. In addition to being utilized for spectral sensitization, dyes may be used for filtration of specific wavelengths of exposing light (either as intergrain absorbers or in separate layers containing no silver halide), for antihalation and for adjustment of the background density (Dmin) of color negative films for printing purposes. Dyes that are used to adjust Dmin for printing as well as for antihalation in color negative films are sometimes referred to as dummy dyes. Yellow and orange dyes that have been used in color negative films for antihalation and for Dmin adjustment have suffered from a number of deficiencies including poor dispersability, improper hue and instability on long term storage or on storage at elevated temperatures. Losses in blue density due to dye instability can result in improper color balance when prints are made from negatives that have been stored for appreciable times either before or after development.

Some yellow dummy dyes that are stable by themselves become unstable when coated in the same layer as other components, such as reducing agents that serve as scavengers for oxidized developer. Thus, there is a need for yellow dyes that retain stability in the presence of other chemicals typically incorporated into color negative films.

Orange dyes have been added to some color negative films, such as KODACOLOR GOLD films, to improve the color balance of color prints made on certain printers. Many color printers scan the average red, green and blue densities of a color negative and use these readings to automatically adjust exposures for proper density and color balance. The peak spectral sensitivities of printer scanners do not always match the peak sensitivities of a color paper. For example, the peak blue sensitivity of KODAK 3510 Printers occurs at approximately 440 nm, whereas the peak blue sensitivity of many color papers is at approximately 480 nm. When two color negative films that have different dye sets with different density ratios at 440 nm vs 480 nm are printed together using a printer such as the KODAK 3510 Printer, the resulting prints will have different color balances, and the two color negative films are said to be printer incompatible. An orange dye with additional absorption at 480 nm relative to 440 nm is sometimes added to the film with the lower One way to attack the instability problem associated with a dye such as C3 is to identify more stable orange dyes. Another approach is to identify stable yellow dyes or orange-yellow dyes with greater absorption in the region of 480 nm and to use such a dye to replace both the yellow and orange dummy dyes used conventionally in combination. It is further desired that such yellow or yellow-orange dummy dyes be readily dispersed and inexpensive to manufacture.

Japanese published patent application 63-064044 discloses photographic materials containing azoaniline dyes but the taught dyes have a maximum absorbance of 470 nm and thus do not have the structures that provide the appropriate dye hue for the purposes of our invention.

U.S. Pat. No. 4,619,893 discloses azoaniline antihalation dyes but the patent does not specifically disclose photographic elements containing azoaniline dyes within the scope of our claims and having the structural features that provide the proper hue.

A problem to be solved is to provide photographic elements that contain dyes that produce prints of proper color balance and that provide a color balance that is not strongly altered during long-term storage due to the decomposition of the dyes.

Summary of the Invention

The invention provides a multicolor negative photographic element which contains a support bearing a yellow dye forming silver halide emulsion layer sensitive to blue light, a magenta dye forming silver halide emulsion layer sensitive to green light, and a cyan dye forming silver halide emulsion layer sensitive to red light, the element comprising a layer containing a yellow or orange-yellow azoaniline dye of structure I

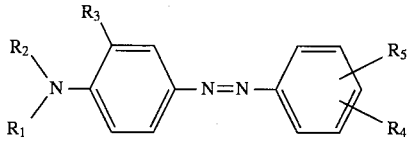

wherein:

$R_1$ is an alkyl group or a phenyl group;

$R_2$ is hydrogen or an alkyl group;

$R_3$ is an alkoxy, aryloxy or alkyl group when $R_2$ is hydrogen, or is hydrogen when $R_2$ is an alkyl group;

$R_1$ and $R_2$ or $R_1$ and $R_3$ may join to form a ring;

$R_4$, which may be in the para or meta position relative to the azo group, is an electron-withdrawing group selected from the group consisting of trifluoromethyl, cyano, halogen, and from alkoxycarbonyl, aryloxycarbonyl, acytoxy, carbonamido, sulfonamido, carbamoyl, sulfamoyl, alkylsulfonyl, arylsulfonyl, sulfonyloxy (—$OSO_3R$), alkoxysulfonyl, aryloxysulfonyl, and sulfoxide groups;

$R_5$ is hydrogen or, can be a chlorine in the meta position when $R_4$ is a chlorine in the para position; and the total number of carbon atoms in $R_1$, $R_2$, $R_3$, and $R_4$ taken together is at least 9; wherein neither a layer sensitive to blue light nor a layer sensitive to green light is located between the support and the layer in which the azoaniline dye is located. The invention also provides a method of forming an image in an element of the invention.

The invention provides photographic elements that contain dyes that produce prints of proper color balance and that provide a color balance that is not strongly altered during long-term storage due to the decomposition of the dyes.

DETAILED DESCRIPTION OF THE INVENTION

The photographic materials of this invention comprise color negative films containing one or more azoaniline dyes coated below (relative to the direction of exposure) the blue- and green-sensitive layers. The dyes of this invention may be coated in an antihalation layer below the red-sensitive layers of the color negative films of this invention. The azoaniline dyes of this invention may also be coated between the green- and red-sensitive layers or on the side of the support opposite to the light-sensitive layers. The color negative photographic elements comprising yellow or orange-yellow dummy dyes have high covering power and thereby require lower laydowns. It is also possible for a single yellow or orange-yellow dummy dye to replace both conventional yellow and orange dummy dyes. The azoaniline dummy dyes are inexpensive to manufacture and readily dispersed.

Useful absorption maxima for the azoaniline dyes of this invention depend upon the spectral band shapes. The spectral absorption maxima for the yellow and orange-yellow azoaniline dummy dyes of this invention are in the range of 430 nm to 465 nm, with 435 nm to 460 nm being the preferable range. The structures of the azoaniline dyes of this invention are chosen to have low water solubility and good oil-phase solubility. For this reason the azoaniline dummy dyes of this invention do not contain charged groups or easily ionizable carboxyl (—COOH) or sulfonate (—$SO_3H$) groups.

Preferred yellow or yellow-orange azoaniline dyes of this invention are represented by formula II:

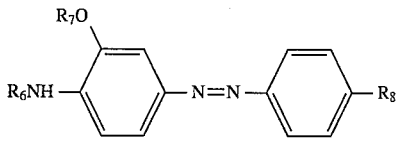

II wherein:

$R_6$ is an alkyl group;

$R_7$ is an alkyl group; and $R_8$ is an alkoxycarbonyl group or a carbamoyl group.

The alkyl group comprising $R_1$, $R_2$, $R_3$, $R_6$ and $R_7$ may unbranched, branched or cyclic and may be unsubstituted or substituted. The alkoxy groups comprising $R_3$ may be unbranched or branched and may be substituted or unsubstituted. The phenyl groups comprising R1 and the phenoxy groups comprising R3 may be unsubstituted or substituted. The electron-withdrawing groups comprising $R_4$ and $R_8$ may also be further substituted. Any substituent may be chosen for the alkyl, alkoxy, phenyl and phenoxy and electron-withdrawing groups that does not adversely affect the performance of the photographic materials of this invention. Suitable substituents include halogen atoms, such as chlorine, aryl groups, hydroxy groups, alkoxy groups, aryloxy groups, acyl groups, acyloxy groups, alkoxycarbonyl groups, aryloxycarbonyl groups, carbonamido groups (including alkyl-, aryl-, alkoxy-, aryloxy- and alkylaminocarbonamido groups), carbamoyl groups, carbamoyloxy groups, sulfonamido groups, sulfamoyl groups, alkylthio groups, arylthio groups, sulfoxide groups, sulfonyl groups, sulfonyloxy groups, alkoxysulfonyl groups, aryloxysulfonyl groups, trifluoromethyl groups, cyano groups, imido groups, alkenyl groups, alkynyl groups and heterocyclilc groups, such as 2-furyl, 2-thienyl, 1-pyrrolyl and N-succinimidyl groups. The phenyl groups comprising $R_1$ and the phenoxy groups comprising $R_3$ may also be substituted with one or more unbranched, branched or cyclic alkyl groups.

The yellow and orange-yellow dyes of this invention are incorporated in the photographic materials of this invention in a conventional manner such as by first dispersing a dye-containing oil phase in an aqueous phase containing a binder, such as gelatin, and one or more surfactants. The dye-containing dispersion is then coated in the appropriate layer of a multilayer film on a suitable support. The oil phase usually consists of the dye dissolved in one or more high-boiling solvents. This is typically added to an aqueous solution of gelatin and surfactant, which is followed by milling or homogenization of the mixture to disperse the oil phase in the aqueous phase as small particles. Removable (by washing or evaporation) auxiliary solvents such as ethyl acetate or cyclohexanone may also be used in the preparation of such dispersions to facilitate dissolution of the dye in the oil phase. However, the preferred dyes of this invention do not require the use of a removable auxiliary solvent for dispersion preparation.

High-boiling solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl-alkyl phosphonates, phosphine oxides (e.g. trioctylphosphine oxide), esters of aromatic acids (e.g. dibutyl phthalate), esters of aliphatic acids (e.g. dibutyl sebacate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl-)sulfoxide), sulfonamides (e.g. N,N-dibutyl-p-toluenesulfonamide) or hydrocarbons (e.g. dodecylbenzene). Additional high-boiling solvents and auxiliary solvents are noted in Research Disclosure, Dec.1989, Item 308119, p 993. Useful dye: high-boiling solvent weight ratios range from about 1:0.1 to 1:10, with 1:0.2 to 1:4.0 being preferred. The azoaniline dyes of this invention may also be dispersed without the use of a permanent high-boiling solvent.

The azoaniline dyes of this invention may be coated in the photographic materials of this invention either alone in one or more layers or together with other dyes or addenda in the same layer or layers. In the photographic materials of this invention the azoaniline dyes are coated under (i.e. further from the direction of exposure) the blue- and green-sensitive layers of multilayer films. It is common to coat these azoaniline dummy dyes in a layer adjacent to the transparent film support and under all of the light-sensitive layers of the multilayer film. However, the azoaniline dyes of this invention may also be coated on the side of the support opposite to the side on which the light-sensitive silver halide-containing layers are coated. The azoaniline dyes of this invention may also be coated between the green-sensitive and red-sensitive layers of the color negative films of this invention. The azoaniline dyes of this invention may also be coated in one or more red-sensitive layers or between two or more red sensitive layers in the color negative films of this invention. Useful coated levels of the yellow or orange-yellow azoaniline dyes of this invention range from about 0.002 g/sq m to 0.150 g/sq m, with coated levels ranging from 0.004 g/sq m to 0.080 g/sq m being preferred.

The yellow and orange-yellow azoaniline dyes of this invention may also be coated in the same layer or in the same dispersion as one or more reducing agents or one or more scavengers of oxidized developer. Reducing agents or scavengers that may be coated in the same layer or the same dispersion as the azoaniline dyes of this invention include hydroquinones, such as 2,5-di-t-octyl hydroquinone, and amidophenols, such as 2,4-(p-dodecyloxyphenyl)sulfonamido phenol.

Examples of nondiffusible yellow or orange-yellow azoaniline dyes of this invention include, but are not limited to, the following (D1–D16):

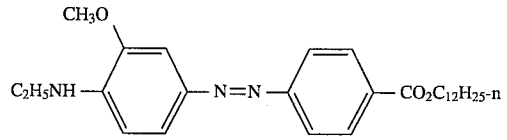

D1

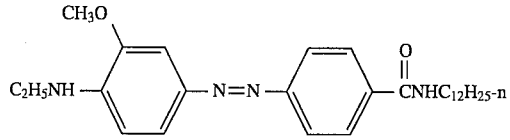

D2

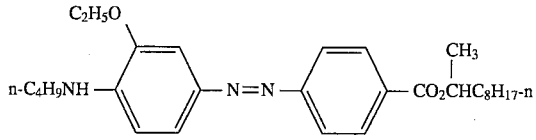

D3

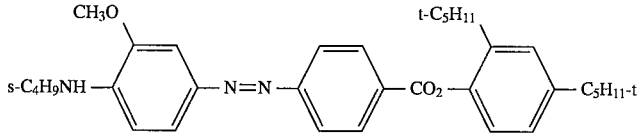

D4

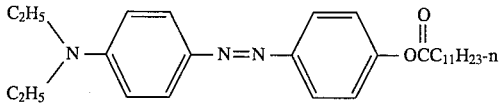

D5

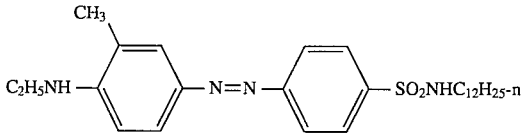

D6

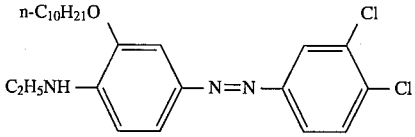

D7

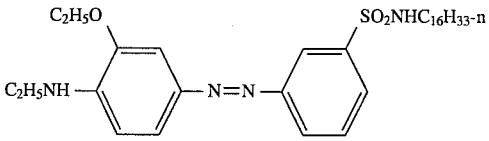

D8

-continued

D9

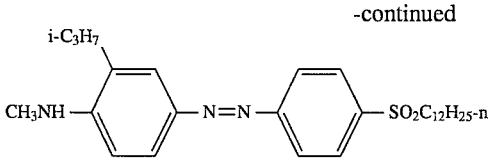

D10

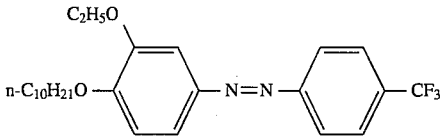

D11

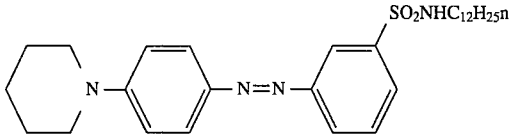

D12

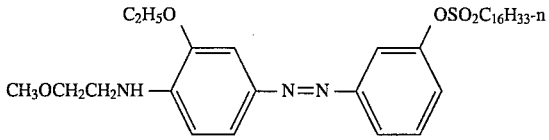

D13

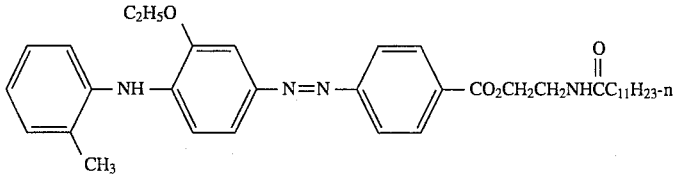

D14

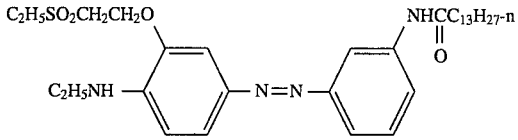

D15

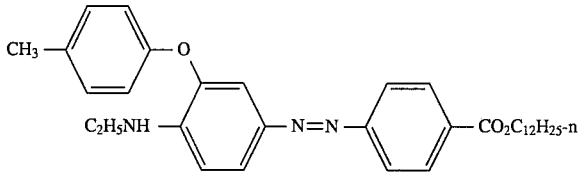

D16

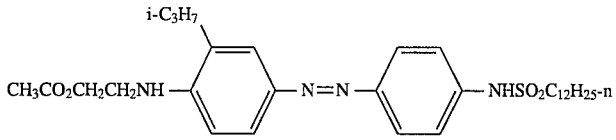

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy) acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5- tetradecylprrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl-)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-ptoluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl] sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, England, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536,and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non colorforming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746, 600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

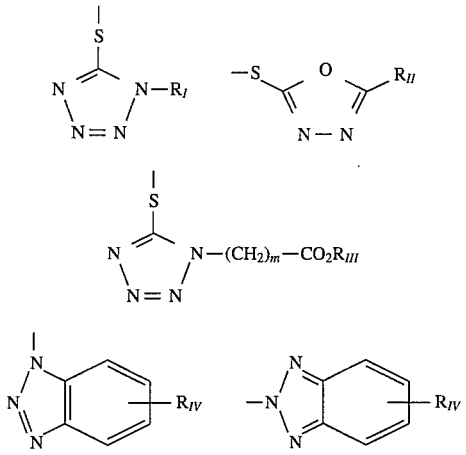

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and $-SR_I$; $R_{III}$ is a straight or branched alkyl group of from 1 to about 5 carbon atoms and m is from 1 to 3; and RiV is selected from the group consisting of hydrogen, halogens and alkoxy, phenyl and carbonamido groups, $-COOR_V$ and $—NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

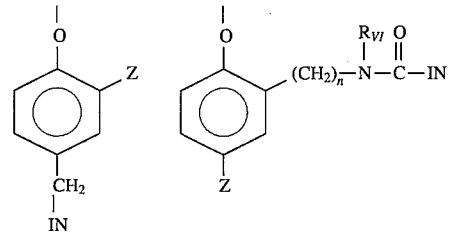

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

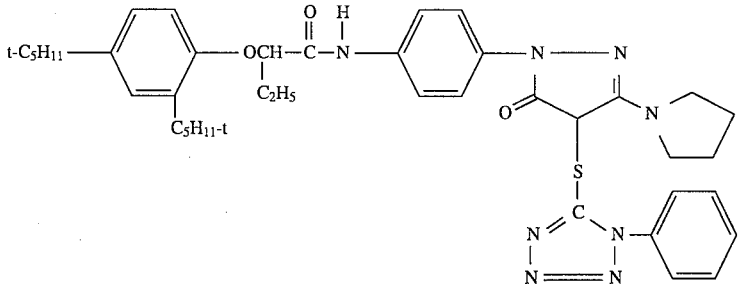

D1

-continued
D2
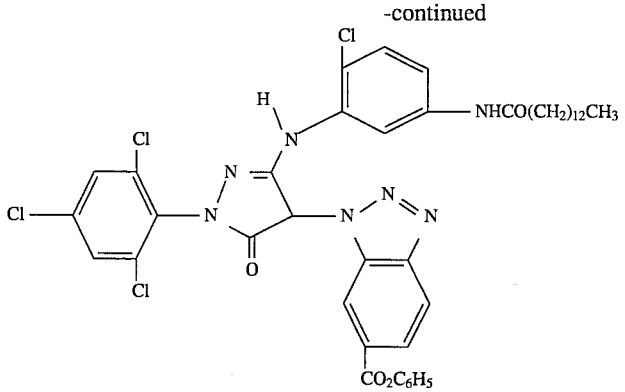
D3
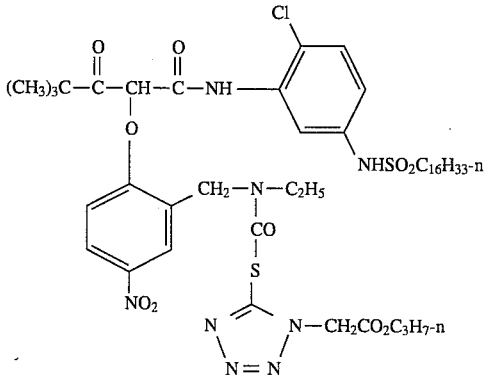
D4
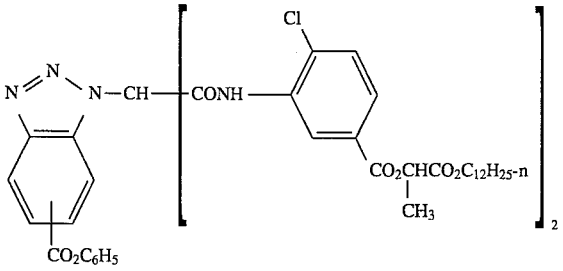
D5
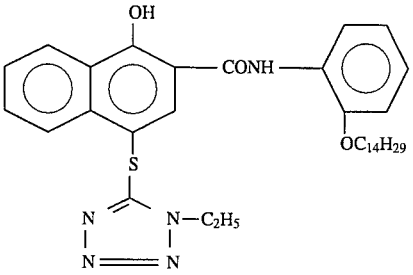

-continued
D6
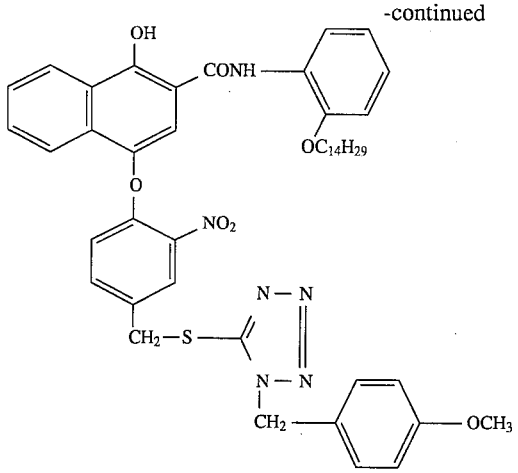
D7
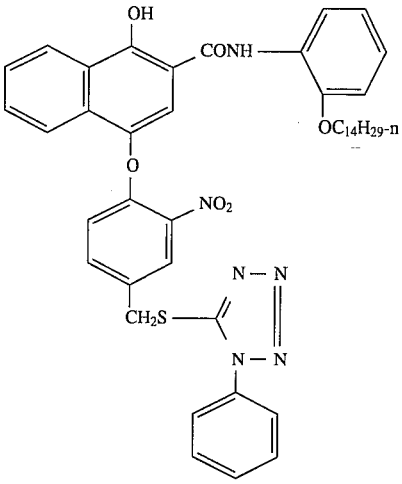
D8
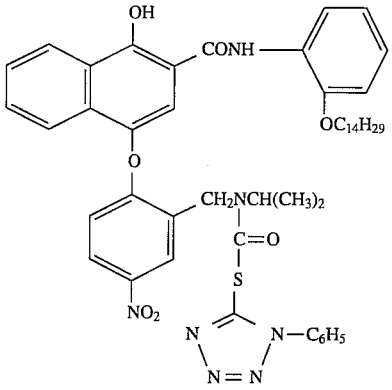

-continued

D9

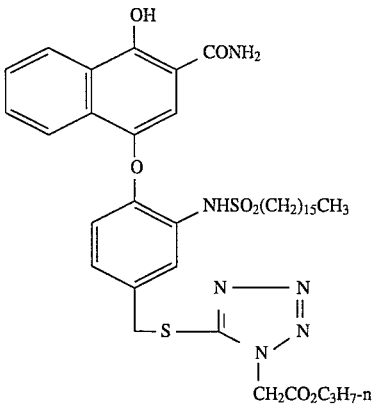

D10

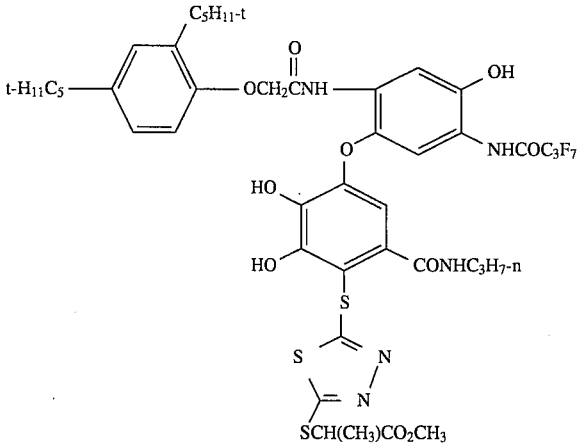

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0,017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C–41 color process as described in The British Journal of Photography Annual of 1988, pages 191–198. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluence sulfonic acid.

Development is usually followed by the conventional steps of bleaching, fixing, or bleach-fixing, to remove silver or silver halide, washing, and drying.

The entire contents of the various patents and other publications cited in this specification are incorporated herein by reference.

The advantages of the azoaniline dyes of this invention and of color negative photographic materials comprising such dyes as dummy dyes are illustrated in the following comparative Examples. These Examples illustrate that, in comparison to dyes of the prior art, the azoaniline dummy dyes of this invention show improved dye stability, improved hue and improved efficiency for maintaining printer compatibility. The high-boiling solvents S-1 and S-2 in used these Examples, refer to tritolyl phosphate (mixed isomers) and dibutyl phthalate, respectively. References are to parts by weight, unless otherwise indicated.

EXAMPLE 1.

Illustration of the Improved Dye Stability of the Azoaniline Dyes of this Invention In this example, single-layer dye coatings were prepared and evaluated with respect to thermal dye stability and dye covering power. D1 and D2 of this invention were coated as well as comparative yellow dyes C1 and C2, whose structures are shown below, and comparative orange dye C3 . D1 and C1 were also coated with the reducing agent R-1 at equal laydown, having the structure below. All coatings contained the high-boiling solvent S-1 at a dye to S-1 weight ratio of 1:2. Dyes C1; C3 and C3 have all been used as dummy dyes in commercial color negative films.

A dispersion of D1 was prepared as follows. An oil phase consisting of 0.03 g of D1, 0.06 g of S-1 and 1.6 ml of ethyl acetate was added to an aqueous phase consisting of 1.0 g of gelatin and 0.1 g of a surfactant (sodium tri-isopropylnaphthalene sulfonate) in 19.9 ml of water. The oil phase was dispersed in the aqueous phase in the form of small particles by passing the mixture through a colloid mill in a manner known in the art. After adding a spreading agent and formaldehyde hardener (0.0075 g) the dispersion was coated at a laydown of 0.10 1/sq m, yielding a dye laydown of about 0.135 g/sq m and a gelatin laydown of about 4.4 g/sq m. The ethyl acetate auxiliary solvent evaporated from the coatings on drying. The other dispersions and coatings were prepared similarly. Sufficient dye was coated to yield an optical density at the dye absorption maximum of approximately 0.7.

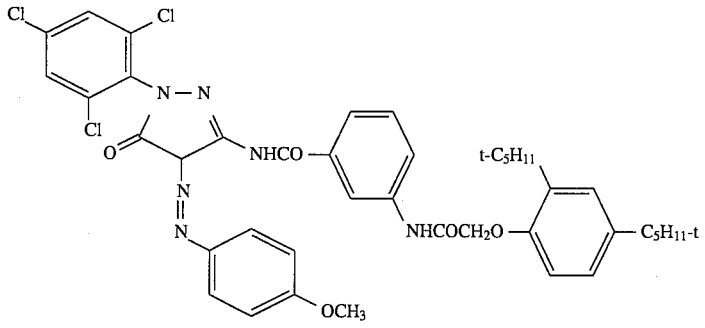

C1

-continued

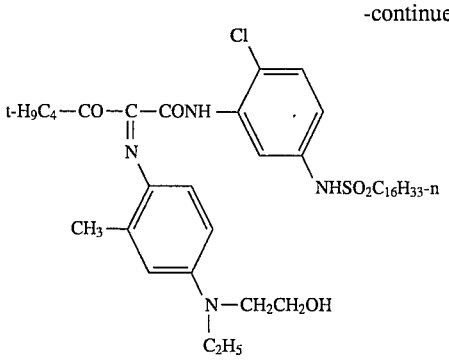

C2

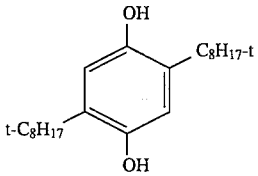

R-1

After hardening, the coatings were washed for 5 min at 25° C. and dried. The dye absorption spectra were measured on a Perkin Elmer Lambda 2S spectrophotometer. Spectral absorption maxima for dyes C1, C2, C3, D1 and D2 were measured as 434 nm, 448 nm, 486 nm, 448 nm and 439 nm, respectively. Film samples were then incubated for 1 wk and 7 wk at 70° C./50% RH and the spectra were remeasured. The density losses due to dye fade on incubation were calculated and are listed in Table I. Dye covering power values (in sq m/g) are also given in Table I. Films containing 1.0 g/sq m of dye will yield a density at the absorption maximum equal to the covering power. Thus covering power provides a measure of the efficiency with which the dyes absorb light of the desired wavelengths.

TABLE I

| Dye/Reducing Agent | Covering Power (sq m/g) | % Density Loss @ 70° C./50% RH 1 wk | 7 wk |
|---|---|---|---|
| C1/none (Comparative) | 2.0 | 0 | 6 |
| C2/none (Comparative) | 1.9 | 2 | 13 |
| C3/none (Comparative) | 5.7 | 50 | 0 |
| D1/none (Invention) | 5.7 | 0 | 0 |
| D2/none (Invention) | 5.6 | 0 | 0 |
| C1/R-1 (Comparative) | — | 11 | — |
| D1/R-1 (Invention) | — | 0 | — |

The comparative data in Table I clearly illustrate two of the major advantages of the azoaniline dyes of this invention. Firstly, the azoaniline dyes of this invention as represented by D1 and D2 have superior stability both alone and in the presence of reducing agents (represented by R-1 ). Neither D1 nor D2 themselves show density losses after storage for 1 or 7 weeks at 70° C./50% RH, and D1 with R1 also shows no density loss after 1 wk at 70° C./50% RH. By themselves C1, C2 and C3 all show density losses on storage at 70° C./50% RH, with the 50% density loss by C3 after only 1 wk being particularly severe. The density loss of C1 is markedly increased when coated with R-1, unlike the D1/R-1 combination. Furthermore, dyes D1 and D2 of this invention have substantially higher covering power than comparative yellow dummy dyes C1 or C2, which allows much lower levels of D1 to be coated.

Example 2.

Preparation of Dispersions of Azoaniline Dye D1 of This Invention without the Use of a Removable Auxiliary Solvent Azoaniline dyes of this invention may be dispersed without the use of auxiliary solvent. Such dispersions, sometimes referred to as direct dispersions, eliminate the need to remove auxiliary solvent by washing or evaporation. An oil phase consisting of 0.20 g of D1 and 0.20 g of S-1 was added to and aqueous phase consisting of 1.25 g of gelatin and 0.12 g of the surfactant sodium tri-isopropylnaphthalene sulfonate in 19.83 ml of water. The oil phase was dispersed in the aqueous phase in the form of small particles by passing the mixture through a colloid mill in a manner known in the art. The dispersion remained free of crystals on cold storage or on storage for 24 hr at 45° C. The dispersion was coated in a manner similar to that in Example 1 to yield a uniform yellow-orange film. In a similar manner direct 1:1 dispersions of D1 with a) dibutyl phthalate (S-2), b) tri-2-ethylhexyl phosphate, c) dibutyldodecanamide and d) dibutyl sebacate were prepared and coated.

Example 3.

Illustration of the Advantages of the Azoniline Dyes of this Invention in a Multilayer Film The multilayer film structure utilized for this example is shown schematically. Structures of components not provided elsewhere are given immediately following the description. Component laydowns are in g/sq m unless otherwise indicated. Gelatin was used as a binder in the various film layers. Yellow dummy dye C1 (0.081 g/sq m) and orange dummy dye C3 (0.014) were used in the antihalation layer (12) of film A. For film B, these dyes were replaced with the single dummy dye D1 of this invention at a level of only 0.048 g/sq m. The films were processed using KODAK FLEXICOLOR C-41 chemistry. Spectra were measured of Dmin (unexposed) are as of the processed films, where most of the density is due to dummy dye. The Dmin spectra of were very similar for films A and B. The processed film samples were then incubated at 70° C./50% RH, following which the Dmin spectra were remeasured. The losses in blue density in the region of 470 nm due to destruction of the yellow and orange dummy dyes were determined and are provided in Table II. The substantial loss in density for comparative film A can lead to improper color balance when stored negatives are printed. This problem is eliminated for film B containing dye D1 of this invention, since no loss in blue density is observed on incubation.

TABLE II

| Multilayer Film | Dummy Dye(s) in AHU | Density Loss at 470 nm After 1 wk at 70° C./50% RH |
|---|---|---|
| A | C1 & C3 | 0.13 |
| B | D1 | 0.00 |

MULTILAYER FILM STRUCTURE

| | |
|---|---|
| 1 Overcoat Layer: | Matte Beads<br>UV Absorber UV-1 (0.111) & S-4 (0.111)<br>UV Absorber UV-2 (0.111) & S-4 (0.111)<br>Silver Bromide Lippmann Emulsion (0.215 Ag)<br>Gelatin (1.08)<br>Bis(vinylsulfonyl)methane Hardener (at 1.75% by weight of total Gelatin) |
| 2 Fast Yellow Layer: | Y-1 (0.200) & S-2 (0.200)<br>Y-2 (0.080) & S-2 (0.027)<br>IR-1 (0.047) (DIAR) & S-2 (0.047)<br>B-1 (0.0054) (BARC) & S-3 (0.0054)<br>CC-1 (0.029) & S-2 (0.029)<br>Silver Iodobroniide Emulsion (0.570 Ag), 9 mole % Iodide (1.0 m)<br>Silver Iodobromide Emulsion (0.226 Ag), 4 mole % Iodide T-Grain (3.0 × 0.14 m)<br>Gelatin (2.0) |
| 3 Slow Yellow Layer: | Y-1 (0.700) & S-2 (0.700)<br>Y-2 (0.280) & S-2 (0.093)<br>IR-1 (0.065) & S-2 (0.065)<br>B-1 (0.0029) & S-3 (0.0029)<br>CC-1 (0.027) & S-2 (0.027)<br>Silver Iodobromide Emulsion (0.549 Ag), 6 mole % Iodide T-Grain (1.0 × 0.26 m)<br>Silver Iodobromide Emulsion (0.285 Ag), 1.3 mole % Iodide T-Grain (0.55 × 0.08 m)<br>Silver Iodobromide Emulsion (0. 172 Ag) 4 mole % Iodide T-Grain (0.81 × 0.09 m)<br>Gelatin (2.6) |
| 4 Interlayer: | YD-2 Filter Dye (0.108)<br>Gelatin (1.29) |
| 5 Fast Magenta Layer: | M-1 (0.060) Magenta Dye-Forming Coupler & S-1 (0.048) & ST-1 (0.012) Addendum<br>MM-1 (0.054) Masking Coupler & S-1 (0.108)<br>IR-2 (0.011) DIR & S-1 (0.022)<br>IR-3 (0.011) DIR & S-2 (0.011)<br>Silver Bromoiodide Emulsion (0.968 Ag), 4 mole % Iodide T-Grain (2.16 × 0.12 m)<br>Gelatin (1.33) |
| 6 Mid Magenta Layer: | M-1 (0.072) & S-1 (0.058) & ST-1 (0.014)<br>MM-1 (0.065) & S-1 (0.130)<br>IR-6 (0.024) DIAR & S-5 (0.048)<br>Silver Bromoiodide Emulsion (0.968 Ag), 4 mole % Iodide T-Grain (1.25 × 0.12 m)<br>Gelatin (1.48) |
| 7 Slow Magenta Layer: | M-1 (0.263) & S-1 (0.210) & ST-1 (0.053)<br>MM-1 (0.065) & S-1 (0.130)<br>Silver Bromoiodide Emulsion (0.560 Ag), 1.3 mole % Iodide T-Grain (0.55 × 0.08 m)<br>Silver Bromoiodide Emulsion (0.313 Ag), 4 mole % Iodide T-Grain (1.00 × 0.09 m)<br>Gelatin (1.78) |
| 8 Interlayer: | Gelatin (1.29) |
| 9 Fast Cyan Layer: | CC-1 (0.138) Cyan Dye-Forming Coupler & S-2<br>CM-1 (0.032) Masking Coupler<br>IR-4 (0.019) DIAR & S-1 (0.076)<br>IR-5 (0.048) DIR & S-1 (0.192)<br>Silver Bromoiodide Emulsion (1.08 Ag), 4 mole % Iodide T-Grain (2.6 × 0.13 m)<br>Gelatin (1.4) |
| 10 Mid Cyan Layer: | CC-1 (0.225) & S-2 (0.225)<br>CM-1 (0.022)<br>IR-4 (0.010) & S-1 (0.040)<br>Silver Bromoiodide Emulsion (0.699 Ag), 4 mole % Iodide T-Grain (1.3 × 0.12 m)<br>Gelatin (1.7) |

TABLE II-continued
| | |
|---|---|
| 11 Slow Cyan Layer: | CC-1 (0.538) & S-2 (0.538)<br>CM-1 (0.027)<br>B-1 (0.038) & S-3 (0.038)<br>Silver Bromoiodide Emulsion (0.430 Ag),<br>1.3 mole % Iodide T-Grain (0.55 × 0.08 m)<br>Silver Bromoiodide Emulsiom (0.473 Ag),<br>4 mole % Iodide T-Grain (1.00 × 0.09 m)<br>Gelatin (1.8) |
| 12 Antihalation Layer: | Grey Silver (0.15 Ag), CD-1 (0.020), MD-1 (0.052)<br>UV-1 (0.075), UV-2 (0.075), DS-1 (0.161), S-1, S-4,<br>Gelatin (2.44) and |
| A | C1 (0.081) plus C3 (0.014) & S-1 (0.028) (Comp.) |
| or B | D1 (0.048) & S-2 (0.048) (Invention) |
Cellulose Triacetate Support
S-1
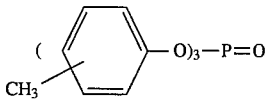
Mixed isomers
S-2
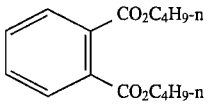
S-3
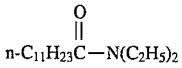
S-4
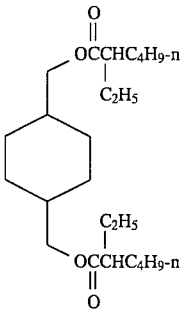
S-5
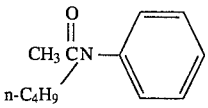
ST-1
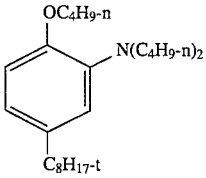
UV-1
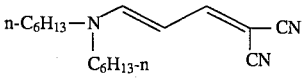

TABLE II-continued
UV-2
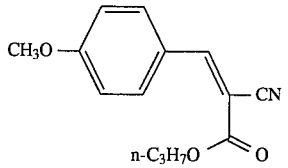
Y-1
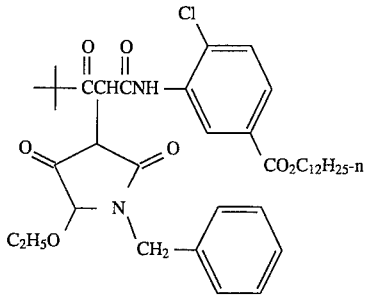
Y-2
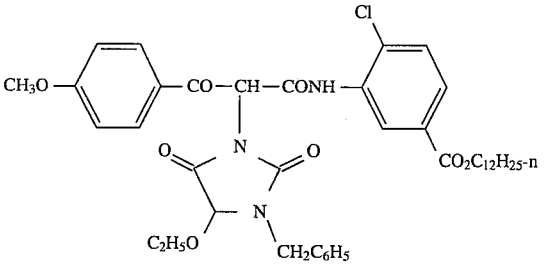
IR-1
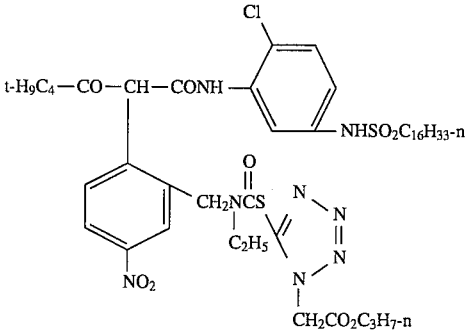
B-1
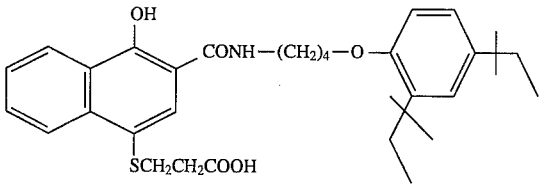
YD-2

TABLE II-continued
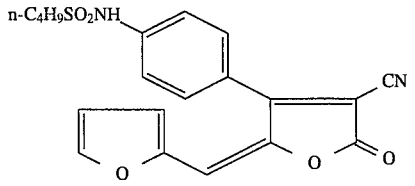
CC-1
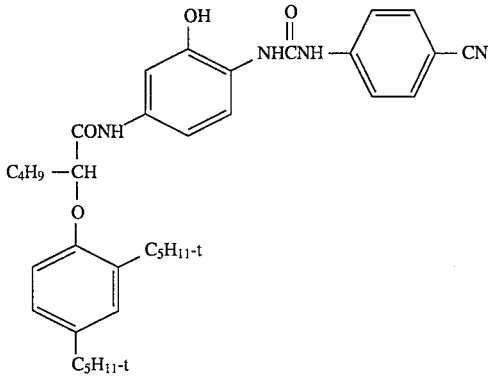
M-1
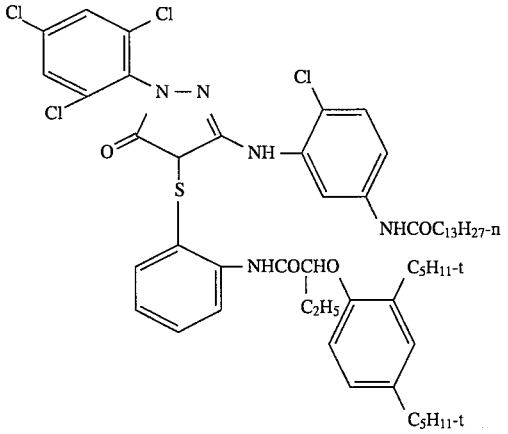
MM-1
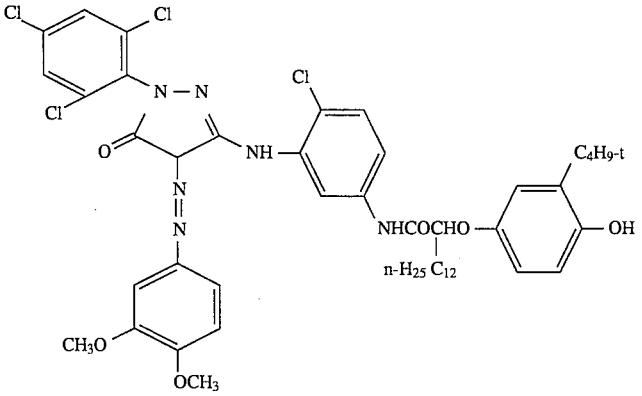
IR-2

TABLE II-continued
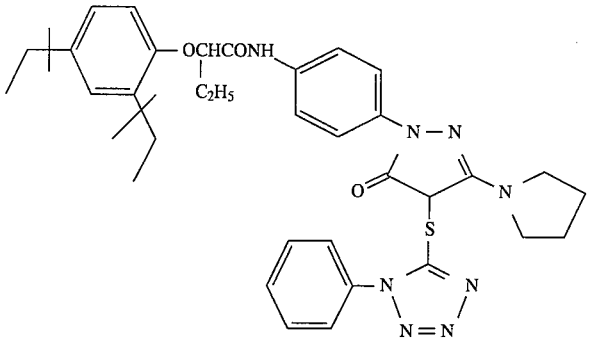
IR-3
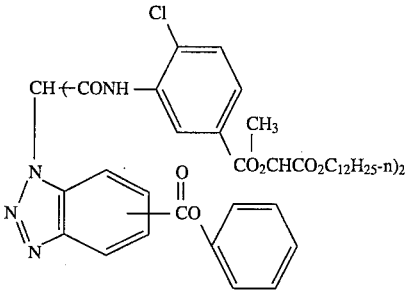
IR-4
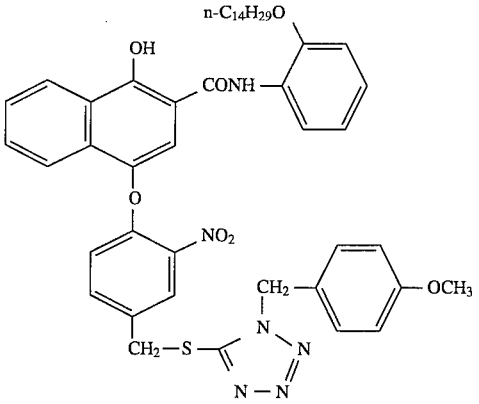
IR-5
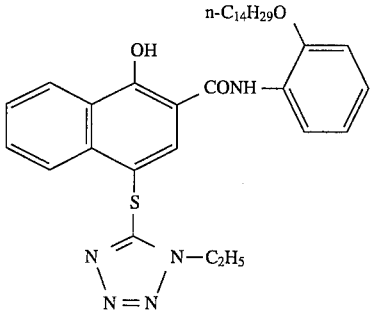
IR-6

TABLE II-continued
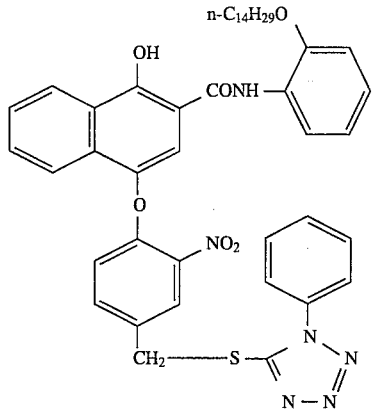
CM-1
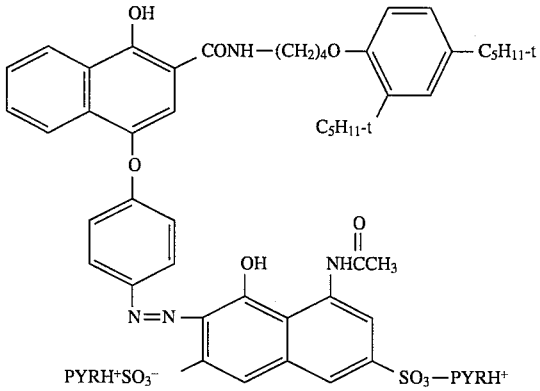
DS-1
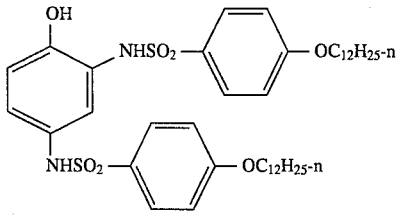
CD-1
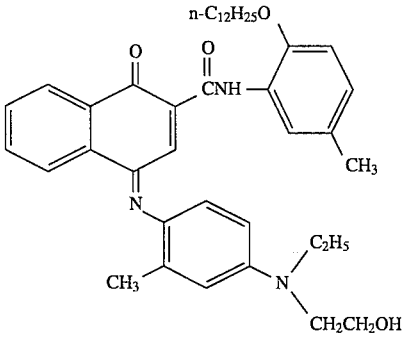
MD-1

TABLE II-continued

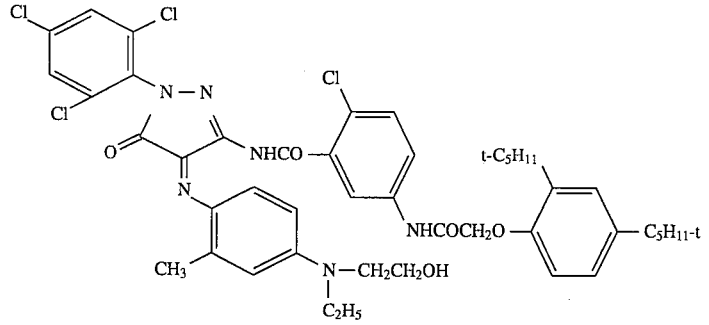

Example 4.

Illustration of the Advantages of the Azoaniline Dyes of this Invention in Another Multilayer Film The multilayer film structure utilized for this example is shown schematically. Structures of components not provided elsewhere are given immediately following. Component laydowns are in g/sq m unless otherwise indicated. Gelatin was used as a binder in the various film layers. Yellow dummy dye C1 (0.081 g/sq m) was used in the antihalation layer (13) of film A. Yellow dummy dye C1 (0.081 g/sq m) and orange dummy dye C3 (0.014 g/sq m) were used together in the antihalation layer of film B. For film B, these dyes were replaced with the single dummy dye D1 of this invention at a level of only 0.038 g/sq m. The films were given a stepwise exposure and processed using KODAK FLEXICOLOR C-41 chemistry. Spectra were measured of Dmin areas of the processed films, where most of the density is due to dummy dye. Table III lists Dmin spectral densities at 440, 460, 480 and 500 nm for films A, B and C. Film B was designed to yield a Dmin spectrum similar to the Dmin spectra of most KODAK KODACOLOR films to render it compatible for printing purposes as discussed above. As shown by the spectral data in Table III, the Dmin densities of film A without orange dummy dye C3 are quite different from those of film B, particularly in region of 480 nm, where the blue record of many color papers is most sensitive. For this reason, film A without orange dummy dye C3 may not be printer compatible on many printers with film B or with commercial films. However, film C comprising the azoaniline dummy dye D1 of this invention, yields Dmin densities much closer to those of film B thereby improving printer compatibility.

TABLE III

| Wavelength (nm) | Dmin Density Film A | Film B | Film C |
|---|---|---|---|
| 440 | 0.93 | 0.97 | 0.95 |
| 460 | 0.86 | 0.92 | 0.91 |
| 480 | 0.77 | 0.84 | 0.85 |
| 500 | 0.70 | 0.76 | 0.77 |

MULTILAYER FILM STRUCTURE

| | |
|---|---|
| 1 Overcoat Layer: | Matte Beads, Gelatin, Bis(vinylsulfonyl)methane Hardener (1.6% of total Gelatin) |
| 2 UV Layer: | UV Absorber UV-1 & S-4<br>UV Absorber UV-2 & S-4<br>Silver Bromide Lippmann Emulsion<br>Gelatin |

TABLE III-continued

| | |
|---|---|
| 3 Fast Yellow Layer: | Y-3 & S-1<br>IR-7 (DIAR) & S-1<br>B-2 (BARC) & S-3<br>Silver Halide Emulsions<br>Gelatin |
| 4 Slow Yellow Layer: | Y-3 & S-1<br>IR-7 & S-1<br>B-2 & S-3<br>Silver Halide Emulsions<br>Gelatin |
| 5 Interlayer: | YD-2 Filter Dye<br>R-1, S-2 & ST-2<br>Gelatin |
| 6 Fast Magenta Layer: | M-1 Magenta Dye-Forming Coupler & S-1 & ST-1<br>MM-1 Masking Coupler & S-1<br>IR-3 DIR & S-2<br>Silver Halide Emulsion<br>Gelatin |
| 7 Mid Magenta Layer: | M-1 & S-1 & ST-1<br>MM-1 & S-1<br>IR-3 & S-2<br>Silver Halide Emulsion<br>Gelatin |
| 8 Slow Magenta Layer: | M-1 & S-1 & ST-1<br>MM-1 & S-1<br>Silver Halide Emulsion<br>Gelatin |
| 9 Interlayer: | R-1, S-2 & ST-2<br>Gelatin |
| 10 Fast Cyan Layer: | CC-1 Cyan Dye-Forming Coupler & S-2<br>CM-1 Masking Coupler<br>IR-4 DIAR & S-1<br>IR-5 DIR & S-1<br>Silver Halide Emulsion<br>Gelatin |
| 11 Mid Cyan Layer: | CC-1 & S-2<br>CM-1<br>IR-4 & S-1<br>B-2 & S-3<br>Silver Halide Emulsion<br>Gelatin |
| 12 Slow Cyan Layer: | CC-1 & S-2<br>IR-4 & S-1<br>B-2 & S-3<br>Silver Halide Emulsions<br>Gelatin |
| 13 Antihalation Layer: | Grey Silver, CD-2, MD-1, UV-1, UV-2, Gelatin and R-1 (0.161) |
| A | C1 (0.081) (Comparison) |
| or B | C1 (0.081), C3 (0.014 ) & S-1 (0.014) (Comparison) |
| or C | D1 (0.038) & S-2 (0.038) (Invention) |

Cellulose Triacetate Support

CD-2

TABLE III-continued

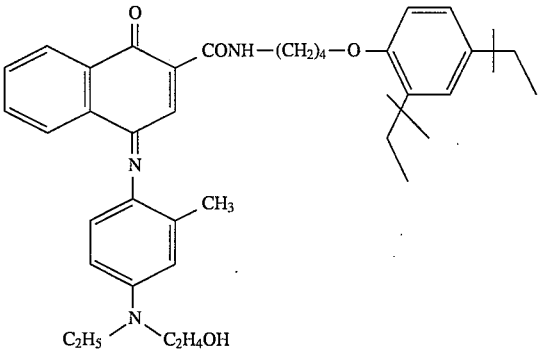

ST-2

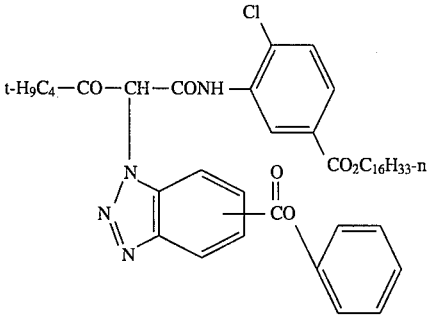

IR-7

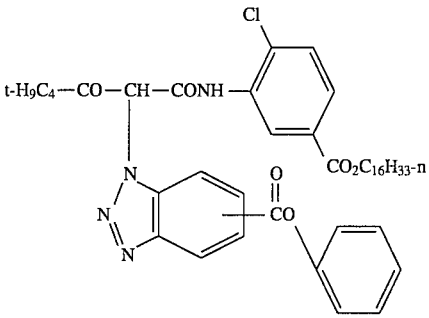

Y-3

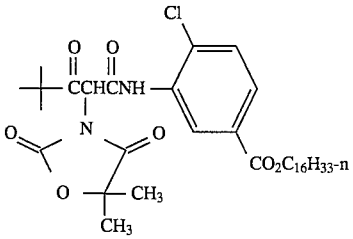

B-2

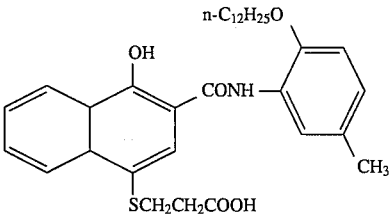

Samples of films A, B and C as well as KODACOLOR GOLD SUPER 200 film were given neutral exposures, processed and printed onto EKTACOLOR EDGE paper using a KODAK 3510A automatic printer that was adjusted to provide optimum color balance for the KODACOLOR GOLD SUPER 200 negatives. The red, green and blue status A densities of the prints were measured, and the densities of prints made from films A, B and C were compared to those of the check prints made from the KODACOLOR GOLD SUPER 200 negatives. The density deviations of prints made from film C containing dummy dye D1 of this invention were generally less than those made from film A containing yellow dummy dye C1 and nearly as small as those of prints made from film B, containing both yellow and orange dummy dyes. Printing incompatibilities were most noticeable in underexposures, and the data in Table IV shows the red, green and blue density deviations from 'neutral' prints made from films A, B and C relative to the KODACOLOR GOLD SUPER 200 check film at two stops less than the normal exposure. It is desirable that all three density differences be less than 0.10. While film C with the single dummy dye of this invention meets this requirement, film A with the single comparative dummy dye does not.

TABLE IV

| | Density Differences vs Check Film for Neutral 2-Stop Under Exposures | | |
|---|---|---|---|
| Film | Red | Green | Blue |
| A | 0.00 | −0.01 | +0.10 |
| B | +0.01 | −0.03 | 0.00 |
| C | +0.02 | −0.00 | −0.05 |

Dmin densities of films A, B and C at 470 nm were measured before and after incubation for three days at 60° C./ 50% RH. The observed density losses are compared in Table V. Comparative multilayer film A shows a loss of 0.07 density units. Comparative multilayer film B, which contains the very unstable dye C3, shows a loss of 0.13 density units. However, multilayer film C of this invention shows no density loss at 470 nm on incubation.

TABLE V

| Multilayer Film | Dummy Dye(s) in AHU | Density Loss at 470 nm After 3 days at 60 C./50% RH |
|---|---|---|
| A | C1 | 0.07 |
| B | C1 + C3 | 0.13 |
| C | D1 | 0.00 |

The preceding examples are set forth to illustrate specific embodiments of this invention and are not intended to limit the scope of the compositions or materials of the invention. Additional embodiments and advantages within the scope of the claimed invention will be apparent to one skilled in the art.

What is claimed is:

1. A multicolor negative photographic elements which contains a support bearing a yellow dye forming silver halide emulsion layer sensitive to blue light, a magenta dye forming silver halide emulsion layer sensitive to green light, and a cyan dye forming silver halide emulsion layer sensitive to red light, the element comprising a layer containing a yellow or orange-yellow azoniline dye of structure I

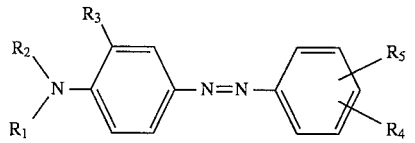

wherein:

$R_1$ is an alkyl group or a phenyl group;

$R_2$ is hydrogen or an alkyl group;

$R_3$ is an alkoxy, aryloxy or alkyl group when $R_2$ is hydrogen, or is hydrogen when $R_2$ is an alkyl group;

$R_1$ and $R_2$ or $R_1$ and $R_3$ may join to form a ring;

$R_4$, which may be in the para or meta position relative to the azo group, is an electron-withdrawing group selected from the group consisting of trifluoromethyl, cyano, halogen, alkoxycarbonyl, aryloxycarbonyl, acyloxy, carbonamido, sulfonamido, carbamoyl, sulfamoyl, alkylsulfonyl, arylsulfonyl, sulfonyloxy (—$OSO_3R$), alkoxysulfonyl aryloxysulfonyl, and sulfoxide groups;

$R_5$ is hydrogen or, can be a chlorine in one meta position relative to azo group when $R_4$ is a chlorine in the para position relative to the azo group; and the total number of carbon atoms in $R_1$, $R_2$, $R_3$, and $R_4$ taken together is at least 9;

wherein said above substituents are selected to provide a spectral absorption maxima in the range of 430 nm to 465nm; and wherein neither a layer sensitive to blue light nor a layer sensitive to green light is located between the support and the layer in which the azoaniline dye is located.

2. A color negative photographic element according to claim 1, wherein the azoaniline dye has the formula II:

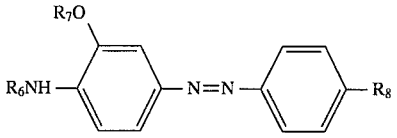

II wherein:

$R_6$ is an alkyl group;

$R_7$ is an alkyl group; and $R_8$ is an alkoxycarbonyl group or a carbamoyl group.

3. A photographic element according to claim 2, wherein $R_8$ is an alkoxycarbonyl group.

4. A photographic element according to claim 3, wherein the azoaniline dye has formula D1

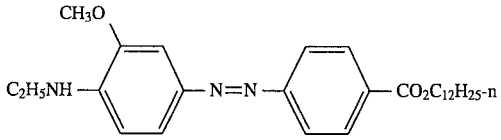

D1

5. A photographic element according to claim 1, wherein the azoaniline dye is located in an antihalation layer adjacent to the support.

6. A photographic element according to claim 1, wherein the azoaniline dye is located between the layers sensitive to green light and a layer sensitive to red light.

7. A photographic element according to claim 1, wherein the azoaniline dye is coated at a level of from 0,002 to 0.150 g/sq m.

8. A photographic element according to claim 7, wherein the azoaniline dye is coated at a level of from 0,004 to 0.08 g/sq m.

9. A photographic element according to claim 1, wherein the azoaniline dye is dispersed together with a high-boiling solvent at a dye:solvent weight ratio of from 0.1 to 10.0 .

10. A photographic element according to claim 1, wherein the azoaniline dye is coated as a dispersion prepared without the use of a removable auxiliary solvent.

11. A photographic element according to claim 1, wherein the azoaniline dye is dispersed together with tritolyl phosphate, dibutyl phthalate, tri-2-ethylhexyl phosphate, N,N-dibutyldodecanamide or dibutyl sebacate.

12. A photographic element according to claim 1, wherein the azoaniline dye is coated in the same layer or in the same dispersion with a reducing agent or a scavenger for oxidized developer.

13. A photographic element according to claim 12, wherein the reducing agent or scavenger is a ballasted hydroquinone derivative.

14. A photographic element according to claim 13, wherein the hydroquinone derivative is 2,5-di-t-octyl hydroquinone.

15. A photographic element according to claim 1, wherein the element contains no yellow or orange dyes besides the azoaniline dye of the invention.

* * * * *